United States Patent [19]

Landry et al.

[11] 4,428,431

[45] Jan. 31, 1984

[54] PERFORABLE SCREEN DEVICE FOR SUBTERRANEAN WELLS AND METHOD OF PRODUCING MULTI-LOBE ZONES

[75] Inventors: Darrell J. Landry, New Orleans; James E. Porter, Lafayette, both of La.

[73] Assignee: Baker International Corporation, Orange, Calif.

[21] Appl. No.: 263,801

[22] Filed: May 14, 1981

[51] Int. Cl.[3] ..... E21B 43/114; E21B 43/08

[52] U.S. Cl. ..... 166/298; 166/278; 166/233; 166/236

[58] Field of Search ..... 166/278, 276, 51, 297, 166/298, 230, 231, 233, 236; 210/457, 437

[56] References Cited

U.S. PATENT DOCUMENTS

| | | | |
|---|---|---|---|
| 3,534,816 | 10/1970 | Showalter | 166/298 X |
| 4,102,395 | 7/1978 | Robinson | 166/231 |
| 4,105,069 | 8/1978 | Baker | 166/51 |
| 4,167,972 | 9/1979 | Sears | 166/233 |
| 4,273,190 | 6/1981 | Baker et al. | 166/278 |

*Primary Examiner*—Ernest R. Purser
*Assistant Examiner*—Thuy M. Bui
*Attorney, Agent, or Firm*—Norvell & Associates

[57] ABSTRACT

A screen device is provided for use in a subterranean well and is carriable within the well on a tubular conduit. The screen has an elongated outer housing with a plurality of flow passageways extending through the housing. An inner perforable cylindrical mandrel with upper and lower ends has at least one of the ends securable with a conduit member of the tubular conduit. The mandrel longitudinally extends through the interior of the housing and is secured against movement relative to the housing. A central passageway in the mandrel communicates with the tubular conduit for transmission of fluid. Prior to perforation of the mandrel, the screen device prevents fluid flow between the flow passageways and the central passageway of the mandrel. Subsequent to perforation of the mandrel, the screen device permits transmission of fluid between the flow passageways, the central passageway and the tubular conduit. The screen device is perforated by means of a conventional jet-producing perforation gun introduced into the well on an auxiliary conduit, such as a wireline, through the tubular conduit. The screen device permits selective production of multi-lobes within one or more production zones in the well.

14 Claims, 12 Drawing Figures

PERFORABLE SCREEN DEVICE FOR SUBTERRANEAN WELLS AND METHOD OF PRODUCING MULTI-LOBE ZONES

BACKGROUND OF THE INVENTION

1. Field of the Invention

The invention relates to the use of a screen device in a subterranean well which prevents fluid transmission therethrough until the mandrel of the screen device is perforated, thereby permitting selective production of, for example, one lobe of a multi-lobe zone within the well.

2. Description of the Prior Art

In the completion of a subterranean oil or gas well, it oftentimes becomes desirable to deposit gravel within the annular area between the perforated casing immediate the production zone and the production string, to prevent migration with the produced hydrocarbons of particulate matter, such as sand, into the tubing string and thence to the top of the well. In conjunction with such gravel packing operations, a slotted liner or screen is well known to the art and may be carried into the well onto a work string or production conduit also defining thereon accessory items such as packers, hangers, cross-over tools, and the like, commonly incorporated in gravel packing assemblies. The screen is positioned in the well adjacent the production zone and the gravel is deposited around the exterior thereof, using any one of a number of known and conventional means and techniques.

In many wells, it is common and characteristic for the production zone to extend longitudinally a considerable distance, such as sixty or more feet. Within such length, the zone may be separated into two or more "lobes", each such lobe defining a separate production strata which may have a quality of production fluid particularly distinguishable from that within other lobes within the zone. It may be desirable, therefore, to be able to produce each such lobe separately and selectively.

Heretofore, when such lobes have been encountered in a well which also required gravel packing because of the physical characteristics of the production zone, one complete length of screen would have to be incorporated into the zone and would be required to straddle both lobes. Thus, the production from each lobe would, of necessity, be co-mingled.

The present invention remedies this, and other, problems encountered with conventional and known gravel pack screen devices by providing a screen device which prevents fluid transmission therethrough to the production or work string conduit until it is selectively perforated by an auxiliary device, such as a jet-action perforating gun. By providing such a device, multi-lobes within a production zone may be selectively and separately produced without co-mingling of the production fluids therein.

SUMMARY OF THE INVENTION

The present invention provides a screen device and a method of producing multi-lobe zones within a subterranean well. The screen device is carriable in the well on a tubular conduit and comprises an elongated outer housing have a plurality of flow passageways extending therethrough. An inner perforable cylindrical mandrel has upper and lower ends, with at least one of the ends being securable with a conduit member of the tubular conduit. The inner mandrel longitudinally extends through the interior of the housing and is secured against movement relative to the housing. A central passageway in the mandrel communicates with the tubular conduit for transmission of fluid. The screen device prior to perforation of the mandrel prevents fluid flow between the flow passageways and the central passageway of the mandrel. Subsequent to perforation of the mandrel, the screen device permits transmission of fluid between the flow passageways, the central passageway and the tubular conduit. The screen device may be perforated by use of a conventional and well known jet-action perforating gun carried on an auxiliary conduit within the tubular conduit. The screen device thereby permits selective and separate production of a lobe of a multi-lobe zone and zones within the subterranean well which have been previously gravel packed.

DESCRIPTION OF THE PREFERRED EMBODIMENTS

Figure 1A:
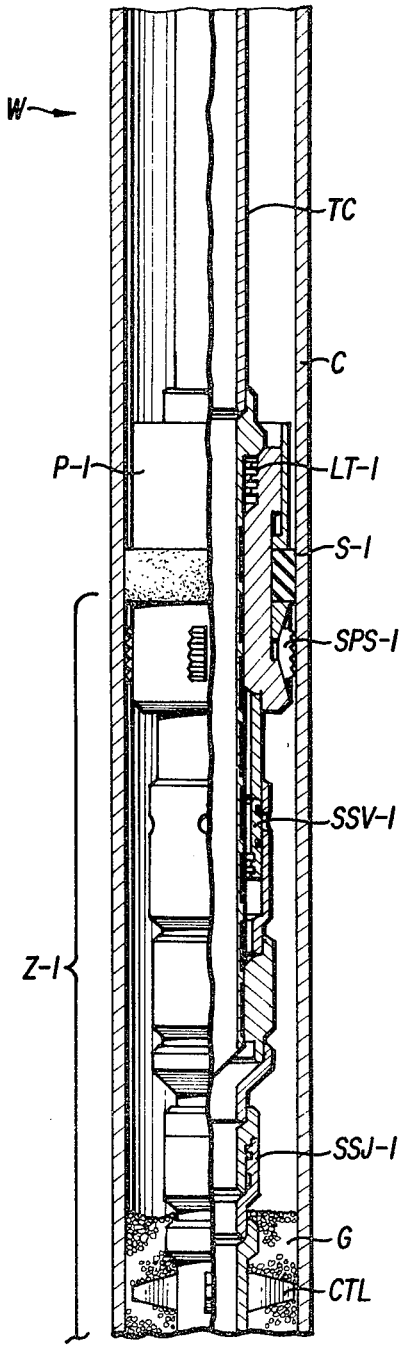
FIGS. 1A, 1B and 1C together constitute a longitudinally extending view of a subterranean well having a plurality of gravel packed production zones and first and second production lobes in each of said zones, the gravel packing assembly incorporating screen devices of the present invention being shown positioned on a tubular conduit in the well.
Figure 1B:
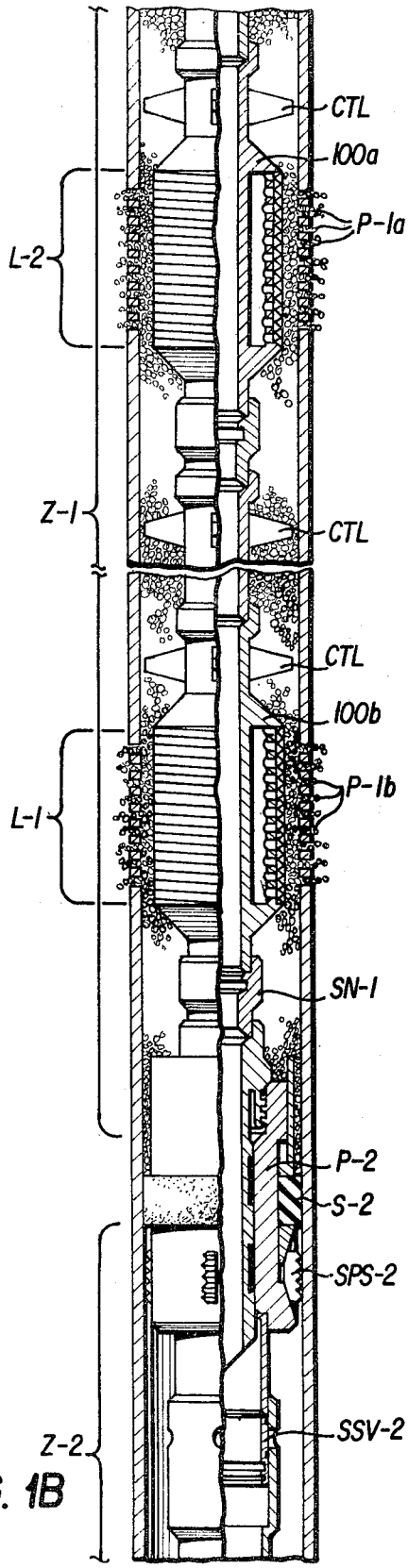
Figure 1C:
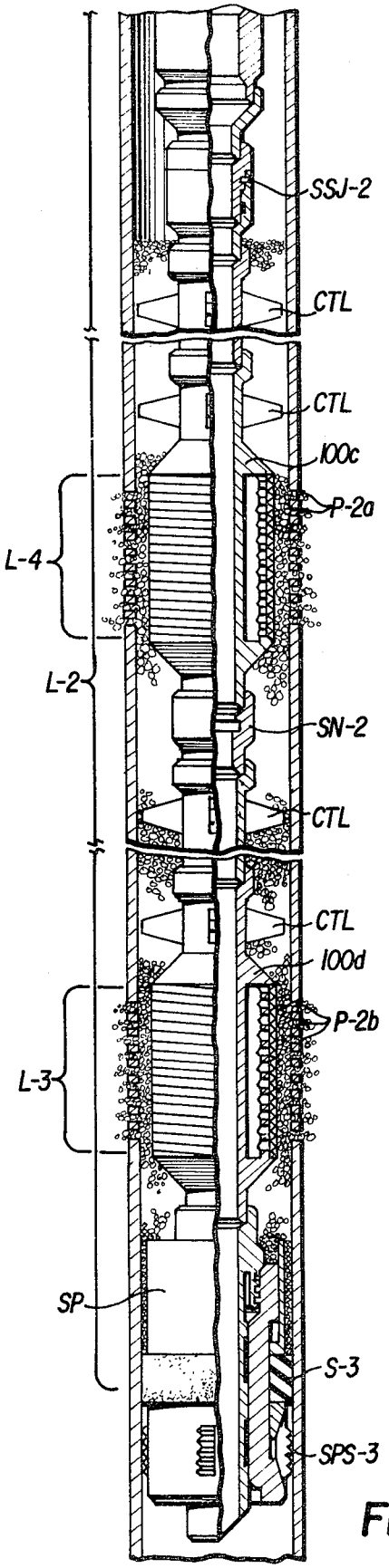

Referring first to FIGS. 1A, 1B and 1C, there is illustrated in cross-sectional view a subterranean well W having an upper production zone Z-1 with a lower lobe L-1 and an upper lobe L-2. The upper zone Z-1 is separated from a lower zone Z-2 by means of a lower packer P-2, the lower zone Z-2 having a lower lobe L-3 and an upper lobe L-4.

The well W receives an elongated casing conduit C extending longitudinally therethrough, with flow passageways to the production zone and the interior of the casing C being provided by means of perforations P-1*a*, P-1*b*, P-2*a* and P-2*b*, adjacent the lobes L-2, L-1, L-4 and L-3, respectively.

As illustrated, a tubular conduit TC carries a conventional gravel packing assembly into the well, such assembly comprising an upper packer P-1 and secured to the conduit TC by a latch LT-1. The upper packer P-1 has a circumferentially extending exterior elastomeric seal element S-1 which is illustrated in FIG. 1A as being sealingly secured relative to the interior of the casing C. The upper packer P-1 is anchored in the well W by the engaged position of the slips SPS-1 along the interior wall of the casing C.

The gravel packing assembly also includes a conventional upper sliding sleeve valve SSV-1 disposed on the tubular conduit TC somewhat below the upper packer P-1, such valve being utilized to provide a flow passageway, selectively, between the interior of the tubular conduit TC and the annular area between the conduit TC and the casing C during the gravel packing operation. The gravel packing assembly also includes an upper shear-out safety joint SSJ-1 which permits the members carried on the tubular conduit TC thereabove to be disengaged from the tubular conduit members therebelow, in the event of an emergency.

Conventional wing-type centralizers CTL are positioned longitudinally and exteriorly around the tubular conduit TC in order to center the gravel packing assembly and the tubular conduit TC in the well subsequent to deposition of the gravel G in the annular area between the tubular conduit TC and the casing C.

As shown in FIGS. 1B and 1C, the gravel packing assembly which is carried on the tubular conduit TC also includes an upper lobe screen device 100*a* which is positioned across the upper lobe L-2 and facing the upper zone upper lobe perforations P-1*a*. An identical screen 100*b* is positioned in the upper zone Z-1 across the lower lobe L-1. Somewhat below the upper zone lower lobe screen 100*b* is a seal nipple SN-2 for selective receipt of a blanking plug BP-1.

The tubular conduit TC carries a lower packer P-2, shown in FIG. 1B in anchored position against the casing C by means of the slips SPS-2, the seal S-2 of the packer P-2 being sealingly engaged around the interior wall of the casing C.

The lower zone Z-2 is defined between the lower packer P-2 and a sump packer SP at the lowermost end of the tubular conduit TC, and the gravel packing assembly. A lower sliding sleeve valve SSV-2 is provided on the tubular conduit TC somewhat below the lower packer P-2, for performing the same function as the upper sliding sleeve valve SSV-1.

As shown in FIG. 1C, a lower shear-out safety joint SSJ-2 is provided on the tubular conduit TC somewhat below the lower sliding sleeve valve SSV-2, for the same purpose and function as the safety joint SSJ-1.

A lower zone upper lobe screen 100*c* is positioned in the well W in the lower zone Z-2 on the tubular conduit TC and across the lower zone upper lobe perforations P-2*a* across the upper lobe L-4. A seal nipple SN-2 is positioned on the tubular conduit TC somewhat below and extending from the screen 100*c* for selective receipt of a wireline- or auxiliary tubing-carried blanking plug device.

Similarly, a lower zone lower lobe screen 100*d* is shown as carried on the tubular conduit TC and positioned in the well W across the lower zone lower lobe perforations P-2*b* which extend within the lower lobe L-3 of the lower zone L-2.

Finally, the gravel packing apparatus and the tubular conduit TC terminate at the lowermost end thereof at a sump packer SP having a seal S-3 in sealing contact with the interior of the casing C and being anchored by means of slips SPS-3.

It will be appreciated that the assembly shown in FIGS. 1A, 1B and 1C constitutes an entire gravel packing apparatus incorporating the screen devices of the present invention in each of the two lobes in each zone. It will also be appreciated that the lower zone Z-2 may be gravel packed independently of the upper zone Z-1, or vice versa. If the lower zone Z-2 is gravel packed and produced prior to gravel packing of the upper zone Z-1, it will not be necessary to run into the well with the assembly for the lower zone Z-2 any of the devices incorporated on the tubular conduit TC above the lower zone Z-2, a production string being sealingly engageable within the lower packer P-2 for production of the respective lobes of the lower zone Z-2 subsequent to the gravel packing operation.

Figure 5:
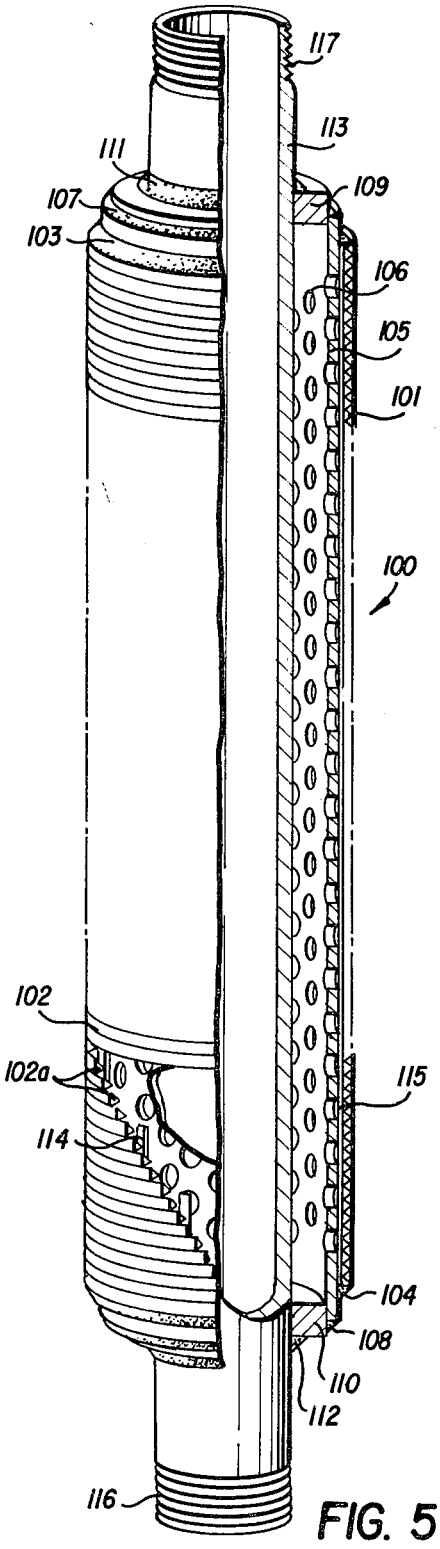
FIG. 5 is an enlarged longitudinal view sectioned to show the interior and exterior of the screen device of the present invention.

As illustrated in FIG. 5, the preferred screen device of the present invention is illustrated by the numeral 100, and represents each of the screens 100*a*, 100*b*, 100*c* and 100*d* in the previous Figs. The screen device 100 consists of a longitudinally extending outer housing 101 having a plurality of exteriorly and circumferentially extending screen mesh elements 102 which define fluid flow passageways 102*a* therebetween. The outer housing 101 prevents the gravel G in the well W from entering the interior of the screen device 100, but permits fluid flow thereacross, selectively, by means of the flow passageways 102*a*. The outer housing 101 is secured by means of welds 103 and 104 to a central ported member 105 having a series of longitudinally extending circumferentially defined ports 106 therein to permit selective flow through the outer housing 101 and to the interior of the screen device 100. The central ported member 105 is secured by means of welds 107 and 108 to upper and lower connecting rings 109 and 110, respectively, the rings 109 and 110 being secured to an inner cylindrical mandrel 113 by means of upper and lower welds 111 and 112, thereby preventing relative movement between the outer housing 101, the ported member 105, and the inner cylindrical mandrel 113.

As shown in FIG. 5, the inner cylindrical mandrel 113 initially is not perforated, and is a solid continuous element, thus preventing fluid flow from the interior of the inner cylindrical mandrel 113 and the ports 106 and the flow passageways 102*a*. The mandrel 113 has at each of its upper and lower ends thread members 117 and 116, respectively, for affixation of at least one end thereof to the tubular conduit TC. Typically, each of the ends of the mandrel 113 will be threadedly engaged to members of the tubular conduit TC.

Within an annular area 115 defined between the central ported member 105 and the outer housing 101 are a series of circularly extending, selectively spaced reinforcing rib elements 114 which are bonded in conventional fashion to the interior of the screen mesh elements 102.

Figure 2A:
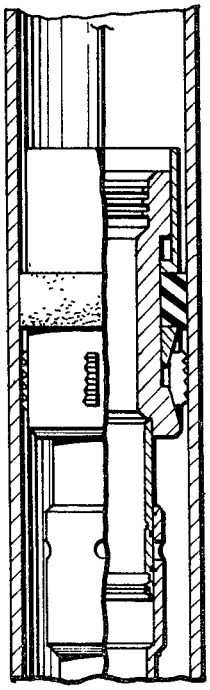
FIGS. 2A and 2B together constitute a longitudinally extending sectional view of the apparatus of FIGS. 1B and 1C, and illustrating a screen device positioned immediate the lower lobe of the lower production zone as the inner mandrel thereof is being perforated by jet-action.
Figure 2B:
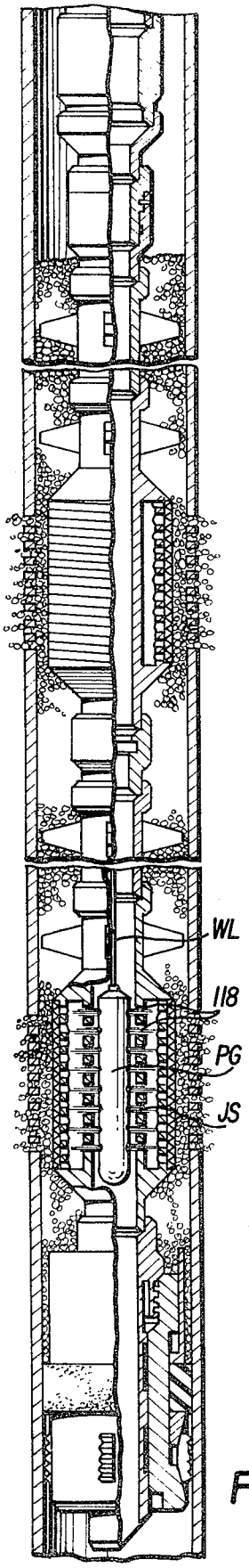

Now referring to FIG. 2B, when it is desired to perforate one of the screen devices 100, a jet-type perforation gun PG is introduced within the tubular conduit TC by means of a wireline WL, or other conduit, and positioned axially and substantially centrally within one of the screen elements 100*a*, 100*b*, 100*c* or 100*d* which is to have its inner cylindrical mandrel 113 perforated. As the jet stream JS is activated by the perforating gun PG, the inner cylindrical mandrel 113 will become perforated at portals or perforated areas 118. Now, the screen device 100 will permit fluid flow through the flow passageways 102*a*, the ports 106, and the interior of the inner cylindrical mandrel 113, for production of fluid within the respective lobe through the tubular conduit TC to the top of the well W.

Figure 6:
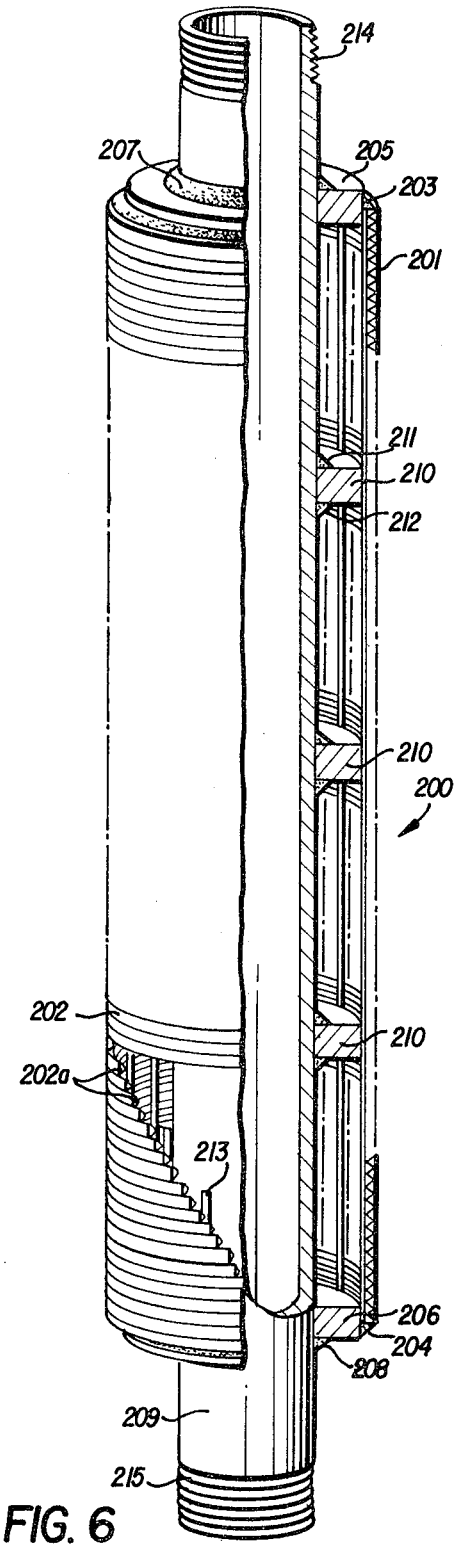
FIG. 6 is a view similar to that of FIG. 5, illustrating an alternate configuration for the screen device of the present invention.

Now referring to FIG. 6, an alternate screen device 200 is illustrated which is quite similar to the construction of the screen device 100 shown in FIG. 5, and the other drawings. The alternate screen device 200 consists of an outer housing 201, which may be identical to the outer housing 101 of the screen device 100. The outer housing 201 is secured by welds 203 and 204 directly to upper and lower rings 205 and 206, respectively. The rings are secured by welds 207 and 208 to a central mandrel 209.

The alternate screen device 200 is stabilized relative to the central mandrel 209 by means of the rings 205 and 206, as well as by means of donut-like centralizers 210 selectively disposed longitudinally within the annular area defined between the outer housing 201 and the central mandrel 209, and secured to the central mandrel 209 by welds 211 and 212. The outer housing 201, similar in construction to that of the outer housing 101 of the screen 100, contains screen mesh elements 202 defining therebetween slotted circularly extending flow passageways 202*a*. Reinforcing ribs 213 may be provided upon the interior of the screen mesh elements 202 for additional strengthening purposes. The central mandrel 209 may receive members of the tubular conduit TC by means of threaded affixations 214 and 215 at each end thereof.

OPERATION

The well W is completed by perforating the casing C in a known fashion. Thereafter, the tubular conduit TC, carrying the desired components of the gravel packing assembly, is lowered into the well W and gravel G is deposited within the zone desired to be produced. Assuming that the lower zone Z-2 is desired to be produced first, and the lower lobe L-3 thereof is desired to be produced first and independently of the upper lobe L-4, the lower zone is gravel packed in conventional fashion by running the tubular conduit TC into the well W, setting the sump packer SP and the lower packer P-2. The tubular conduit TC and the gravel packing assembly components for completion of the upper zone Z-1 may or may not be carried with those utilized in gravel packing of the lower zone Z-2. Assuming that the upper zone Z-1 is not to be gravel packed in conjunction with the gravel packing of the lower zone Z-2, the tubular conduit TC is run into the well and, upon completion of the gravel packing operation, the tubular conduit is disengaged from the lower packer P-2, as is illustrated in FIGS. 2A and 2B. It should be noted that the well is under complete control because the inner cylindrical mandrels 113 of the screens 100*c* and 100*d* have not been perforated.

Now, the perforating gun PG may be carried on the wireline WL and positioned across the screen 100*d* to perforate the mandrel of the screen 100*d* to produce the lower zone lower lobe L-3. As the perforating gun PG is activated, the jet stream JS will perforate the mandrel to define the perforated areas 118 therein. Production fluid may now flow from the lower zone lower lobe perforations P-2*b*, through the flow passageways 102*a* in the outer housing 101 of the screen device, thence through the ports 106 of the central ported member 105, thence through the perforated areas 118 of the inner cylindrical mandrel 113, and through the tubular conduit TC, upwardly, to the top of the well W. It should be noted that the production fluid produced through the tubular conduit TC from the lower lobe L-3 is not combined in any way with the fluid contained in the lower zone upper lobe L-4, because the mandrel in the screen 100*c* has not been perforated.

Figure 3A:
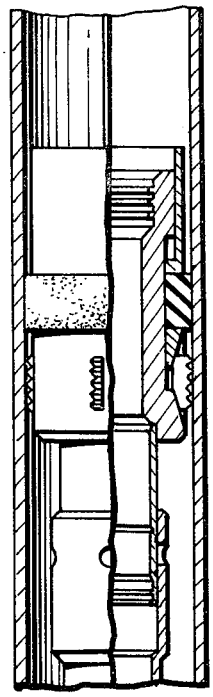
FIGS. 3A and 3B together constitute a longitudinally extending sectional view similar to the view of FIGS. 2A and 2B, illustrating the perforation of the inner mandrel of the screen device positioned adjacent the upper lobe of the lower production zone, a blanking plug being positioned below said screen device to isolate production flow in the conduit therebelow.
Figure 3B:
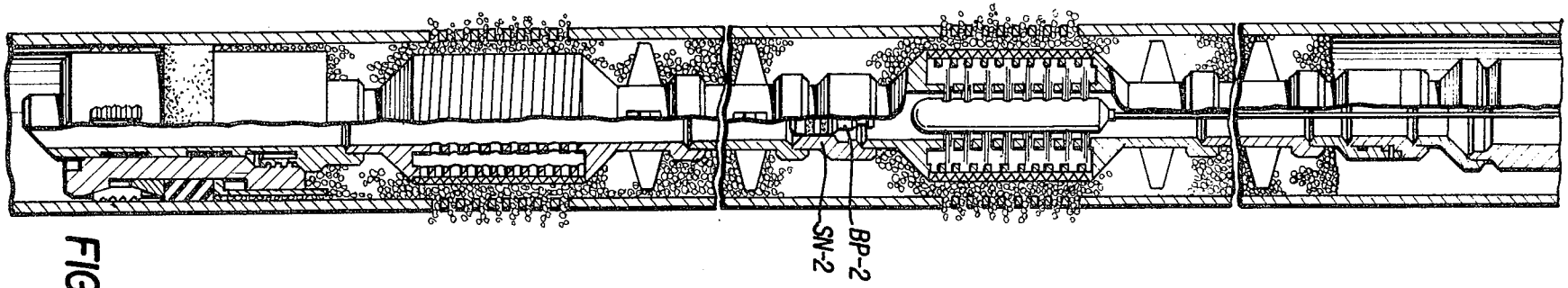

Upon completion of the production of the lower lobe L-3 of the lower zone Z-2, a blanking plug BP-2 is run into the well on wireline, or work string, in a known manner, and sealingly engaged within the seal nipple SN-2 to isolate the lower lobe L-3 therebelow. Now, the perforating gun PG is again run within the well W on the wireline WL to perforate the mandrel of the screen 100*c* in the upper lobe of the lower zone, as illustrated in FIGS. 3A and 3B.

Figure 4A:
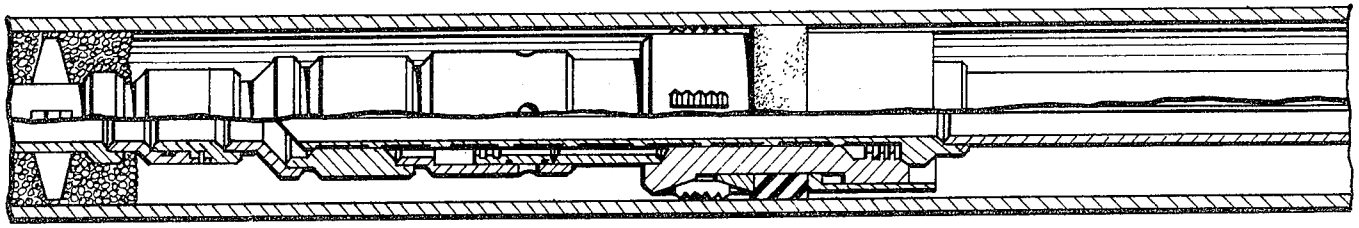
FIGS. 4A, 4B and 4C together constitute a longitudinally extending sectional view similar to that of FIGS. 1A, 1B and 1C, illustrating the perforation by jet-action of the inner mandrel of the screen device positioned adjacent the lower lobe of the upper production zone, each of the mandrels of the screen devices adjacent each of the lobes in the lower production zone having been perforated, blanking plugs being positioned in sealing engagement relative to the tubular conduit below each of the lower lobe screen of the upper production zone and the upper lobe screen of the lower production zone.
Figure 4B:
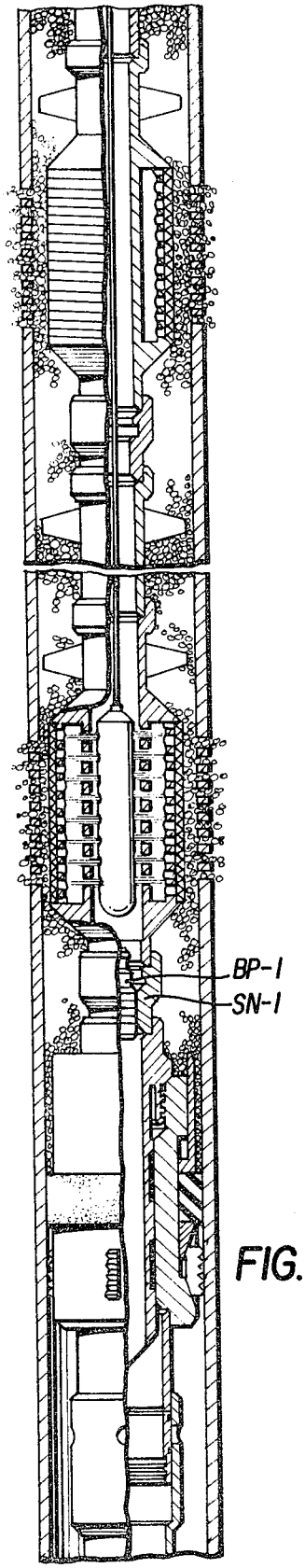
Figure 4C:
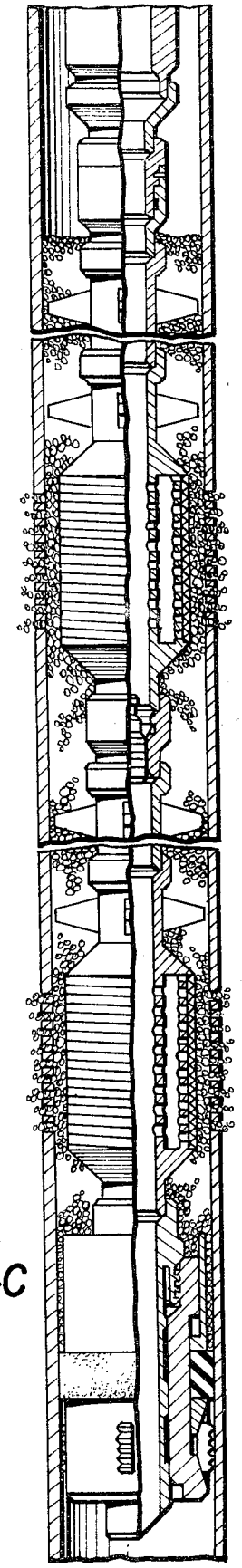

Upon completion of the production in the upper lobe L-4 of the lower zone Z-2, the lobes within the upper zone Z-1 may be produced subsequent to running on a wireline or work string a blanking plug BP-1 for sealing engagement within the upper seal nipple SN-1, to isolate each of the lobes within the lower zone Z-2 from the zone Z-1 thereabove. Again, the perforating gun PG is introduced into the well W on the wireline WL and the jet action upon activation of the perforation gun PG perforates the mandrel of the screen, as is illustrated in FIG. 4B. It will be appreciated that this upper zone lower lobe L-1 may be produced indenpendently of flow co-mingling or interference from fluids within one or more of the lobes L-3 and L-4 in the lower zone Z-2 because of the positioning of the blanking plug BP-1 within the seal nipple SN-1. Additionally, the lower lobe L-1 of the upper zone Z-1 is produced independently of the upper lobe L-2, because the mandrel within the upper lobe screen 100*a* has not been perforated.

Finally, the upper zone lobe L-1 may be produced by repeating the sequence of operations for each of the lobes L-2, L-3 and L-4, described below.

Although the invention has been described in terms of specified embodiments which are set forth in detail, it should be understood that this is by illustration only and that the invention is not necessarily limited thereto, since alternative embodiments and operating techniques will become apparent to those skilled in art in view of the disclosure. Accordingly, modifications are comtemplated which can be made without departing from the spirit of the described invention.

What is claimed and desired to be secured by Letters Patent is:

1. A method of completing and producing a subterranean well having a plurality of production lobes within at least one productive zone around the bore of said well, comprising:

(1) introducing into said well a gravel packing assembly carried on a tubular conduit;

(2) gravel packing said productive zone and each of said lobes with said assembly by introducing through said gravel packing assembly and within said tubular conduit a gravel packing carrier fluid having particulate matter therein and circulating said fluid within the bore of said well within said production zone to deposit the particulate matter within the interior of said well bore immediate each of said lobes;

(3) positioning across each lobe a screen device carried on said tubular conduit, comprising: an elongated outer housing having a plurality of flow passageways extending therethrough; an inner perforable cylindrical mandrel having upper and lower ends, at least one of said ends being securable with a conduit member of said tubular conduit, said inner mandrel longitudinally extending through the interior of said housing; a central passageway in said mandrel communicable with said tubular conduit for transmission of fluid; and means for securing said mandrel against movement relative to said housing, said screen device prior to perforation of said mandrel preventing fluid flow between said flow passageways and the central passageway of said mandrel, said screen device subsequent to perforation of said mandrel permitting transmission of fluid between said flow passageways, said central passageway and said tubular conduit;

(4) introducing within said tubular conduit a jet-action perforation gun, said gun being carried through said conduit on an auxiliary conduit;

(5) positioning said gun within the interior of one of said screen devices;

(6) activating said gun to perforate said mandrel whereby production fluid within the lobe adjacent to the screen device with the mandrel perforated by said jet-action may be transmitted through the flow passageways and the central passageway of said perforated screen device and through said tubular conduit, the flow of said produced fluid thereby not being substantially co-mingled with production fluid within all other lobes within said well.

2. The method of claim 1 further comprising the step of:

(7) introducing within said tubular conduit an auxiliary sealing device carried through said tubular conduit on an auxiliary conduit and landing said sealing device on said tubular conduit above a perforated screen device subsequent to completion of production of said lobe adjacent the perforated screen device and prior to production of another lobe thereabove.

3. A method of completing and producing a subterranean well having a plurality of production lobes within at least one productive zone around the bore of said well, comprising:

(1) introducing into said well a gravel packing assembly carried on a tubular conduit;

(2) gravel packing the lowermost productive zone in each of said lobes within said lowermost zone with said assembly by introducing through said gravel packing assembly and within said tubular conduit a gravel packing carrier fluid having particulate matter therein and circulating said fluid within the bore of said well within said production zone to deposit the particulate matter within the interior of said well bore immediate each of said lobes within said lowermost productive zone;

(3) positioning across each lobe within said lowermost productive zone a screen device carried on said tubular conduit, comprising: an elongated outer housing having a plurality of flow passageways extending therethrough; an inner perforable cylindrical mandrel having upper and lower ends; at least one of said ends being securable with a conduit member of said tubular conduit, said inner mandrel longitudinally extending through the interior of said housing; a central passageway in said mandrel communicable with said tubular conduit for transmission of fluid; and means for securing said mandrel against movement relative to said housing, said screen device prior to perforation of said mandrel preventing fluid flow between said flow passageway and the central passageway of said mandrel, said screen device subsequent to perforation of said mandrel permitting transmission of fluid between said flow passageways, said central passageway and said tubular conduit;

(4) introducing within said tubular conduit a jet-action perforation gun, said gun being carried through said conduit on an auxiliary conduit;

(5) positioning said gun within the interior of the screen device adjacent the lowermost lobe in said lower productive zone;

(6) activating said gun to perforate said mandrel whereby production fluid within the said lowermost lobe may be transmitted through the flow passageways and the central passageway of said perforated screen device adjacent said lowermost lobe and through said tubular conduit, the flow of said produced fluid thereby not being substantially comingled with production fluid within all other lobes within said well.

4. The method of claim 3 further comprising the steps of:

(7) introducing within said tubular conduit an auxiliary sealing device carried through said tubular conduit on an auxiliary conduit and landing said sealing device on said tubular conduit above the lowermost lobe subsequent to completion of production of said lowermost lobe to prevent fluid transmission through said screen device and within said tubular conduit to the top of the well; and (8) repeating steps 4, 5 and 6 of claim 3 with respect to the lobe thereabove.

5. A gravel packing screen assembly for use in a subterranean well bore and carriable on a tubular conduit below a seal member selectively positionable in said well bore for isolating a production zone, with particulate matter deposited around said tubular conduit and surrounding a gravel packing screen device, said screen device comprising: an elongated outer housing having a plurality of flow passageways extending therethrough; said flow passageways permitting the flow of production fluid therethrough and preventing the flow of particulate matter therethrough; an inner perforable cylindrical mandrel having upper and lower ends, at least one of said ends being securable with a conduit member of said tubular conduit, said inner mandrel longitudinally extending through the interior of said housing; a central passageway in said mandrel communicable with said tubular conduit for transmission of fluid; and means for securing said mandrel against movement relative to said housing, said screen device prior to perforation of said mandrel preventing fluid flow between said flow passageways and the central passageway of said mandrel, said screen device subsequent to perforation of said mandrel permitting transmission of fluid between said flow passageways, said central passageway and said tubular conduit.

6. The device of claim 5 further comprising a plurality of reinforcing members longitudinally and circumferentially extending around the interior of said elongated outer housing.

7. The device of claim 5 or 2 further comprising a plurality of longitudinally spaced reinforcing centralizing means positioned within the annular area between the elongated outer housing and the inner perforable cylindrical mandrel and secured to at least one of said housing and said mandrel.

8. The device of claim 5 or 6 further comprising a tubular member longitudinally disposed between said outer housing and said mandrel and secured against movement relative to said outer housing and said mandrel and having a series of circumferentially extending ports defined thereon.

9. A gravel packing assembly for use in a subterranean well bore and carriable in said well on a tubular conduit having conduit members, comprising: a seal member selectively positionable in said well bore above a production zone to be gravel packed for isolating said zone from the well bore thereabove; means for circulating a gravel packing carrier fluid and particulate matter in said fluid through said conduit and said well for deposition of said particulate matter in the bore of the production zone exterior of said conduit; a screen device carriable in said well bore on said tubular conduit and positionable in said bore within said zone, said screen device comprising: an elongated outer housing having a plurality of flow passageways extending therethrough; an inner perforable cylindrical mandrel having upper and lower ends, at least one of said ends being securable with a conduit member of said tubular conduit, said inner mandrel longitudinally extending through the interior of said housing; a central passageway in said mandrel communicable with said tubular conduit for transmission of fluid; and means for securing said mandrel against movement relative to said housing, said screen device prior to perforation of said mandrel preventing fluid flow between said flow passageways and the central passageway of said mandrel, said screen device subsequent to perforation of said mandrel permitting transmission of fluid between said flow passageways, said central passageway and said tubular conduit.

10. The assembly of claim 9 further comprising means for perforating said cylindrical mandrel by jet-action subsequent to said screen device being positioned in said bore within said zone, said perforating means being carriable on an auxiliary conduit extendible within said tubular conduit.

11. The assembly of claim 9 or 10 further comprising means for selectively sealing the interior of the tubular conduit to prevent fluid transmission between at least one conduit member therebelow and at least one conduit member thereabove and subsequent to perforation of said cylindrical mandrel.

12. A gravel packing assembly for use in a subterranean well bore having a plurality of production zones therein, at least one of said zones having a plurality of production lobe members, said gravel packing assembly being carriable in said well on a tubular conduit having conduit members, said assembly comprising: a seal member selectively positionable in said well bore above each production zone to be gravel packed, for isolating said zone from the well bore thereabove; means for circulating a gravel packing carrier fluid and particulate matter in said fluid through said conduit and said well for deposition of said particulate matter in the bore of the selected production zone to be gravel packed and exteriorly around said conduit; a plurality of screen devices carriable in said well bore on said tubular conduit, each of said screen devices being positionable in said well bore within said production zone to be gravel packed and adjacent each of said lobe members, each of said screen devices comprising: an elongated outer housing having a plurality of flow passageways extending therethrough; an inner perforable cylindrical mandrel having upper and lower ends, at least one of said ends being securable with a conduit member of said tubular conduit, said inner mandrel longitudinally extending through the interior of said housing; a central passageway in said mandrel communicable with said tubular conduit for transmission of fluid; and means for securing said mandrel against movement relative to said housing, each of said screen devices prior to perforation of said mandrel preventing fluid flow between said flow passageways and the central passageway of said mandrel, each of said screen devices subsequent to perforation of said mandrel permitting transmission of fluid between said flow passageways, said central passageway and said tubular conduit.

13. The assembly of claim 12 further comprising means carriable within said tubular conduit and selectively positionable within each of said screen devices for perforation of said mandrel.

14. The assembly of claim 12 and 13 further comprising sealing means carriable within said conduit member and selectively positionable above one of the screen devices, and means on said conduit for sealing receipt and engagement of said seal to prevent longitudinal movement thereof in at least one direction on said conduit, said seal when in locked position preventing fluid flow from the upstream side of said seal within said tubular conduit to the downstream side of said seal within said tubular conduit.

* * * * *